US007493950B2

(12) United States Patent
Tinnen

(10) Patent No.: US 7,493,950 B2
(45) Date of Patent: Feb. 24, 2009

(54) DEVICE FOR A LONG WELL TOOL

(75) Inventor: Bård Martin Tinnen, Stavanger (NO)

(73) Assignee: Aker Well Service AS (NO)

( * ) Notice: Subject to any disclaimer, the term of this patent is extended or adjusted under 35 U.S.C. 154(b) by 297 days.

(21) Appl. No.: 10/511,548

(22) PCT Filed: Apr. 14, 2003

(86) PCT No.: PCT/NO03/00123

§ 371 (c)(1),
(2), (4) Date: May 3, 2005

(87) PCT Pub. No.: WO03/097987

PCT Pub. Date: Nov. 27, 2003

(65) Prior Publication Data

US 2005/0217846 A1 Oct. 6, 2005

(30) Foreign Application Priority Data

Apr. 19, 2002 (NO) ..... 20021841

(51) Int. Cl.
*E21B 17/14* (2006.01)

(52) U.S. Cl. ..... 166/242.8; 267/125

(58) Field of Classification Search ..... 166/242.8; 267/125

See application file for complete search history.

(56) References Cited

U.S. PATENT DOCUMENTS

| | | | | |
|---|---|---|---|---|
| 3,100,452 | A * | 8/1963 | Grimmer et al. | 417/109 |
| 4,545,434 | A | 10/1985 | Higgins | |
| 4,735,402 | A * | 4/1988 | Davis | 267/64.13 |
| 4,924,952 | A * | 5/1990 | Schneider | 175/4.54 |
| 5,700,968 | A | 12/1997 | Blimke | |
| 6,223,818 | B1 * | 5/2001 | Hrupp | 166/63 |
| 6,817,598 | B2 * | 11/2004 | Parrott et al. | 267/125 |

FOREIGN PATENT DOCUMENTS

| | | |
|---|---|---|
| EP | 0 658 683 A1 | 6/1995 |
| EP | 0 921 267 A2 | 6/1999 |
| WO | WO 01/90530 A1 | 11/2001 |

* cited by examiner

*Primary Examiner*—Giovanna C Wright
(74) *Attorney, Agent, or Firm*—Finnegan, Henderson, Farabow, Garrett & Dunner L.L.P.

(57) ABSTRACT

Device for a tool string (2) for insertion in a well, the tool string (2) being provided with a brake nose (1).

20 Claims, 9 Drawing Sheets

DEVICE FOR A LONG WELL TOOL

BACKGROUND OF THE INVENTION

1. Field of the Invention

This invention concerns a device to remedy risks occurring during sluicing (lock-in) of long tools in a petroleum well, especially when using tools of a length extending through at least one of the well's wellhead valves during sluicing into the well.

2. Discussion of the Background Art

According to prior art of completing a petroleum well, a production tubing is set after cementing a casing in the formation. For a cased well there is no communication between the reservoir and the well at this stage. It is therefore necessary to perforate the well.

Wells are commonly perforated by means of firing directional explosive charges against the casing wall. The charges penetrate the casing wall, creating channels a distance into the reservoir. The reservoir fluid, for example oil, then may flow freely into the well.

To attain a best possible perforation, it is desirable to perforate the well while underbalanced, i.e. the pressure in the well is less than the reservoir pressure during the perforation operation. When perforating an underbalanced well, and immediately after the perforation, the well fluid will flush particles and slag formed during the perforation into the casing. This prevents the perforation and the formation adjacent to the casing from being blocked by said particles. For the same reason it is desirable that the entire reservoir zone be perforated simultaneously.

During operations in a pressurized well, and according to an ordinary requirement, at least two barriers arranged to prevent unwanted outflow from the well must exist at all times. Thus a safety valve, a so-called well safety valve (WSV), is positioned down in the well in addition to the wellhead valves already existing at the wellhead.

During lock-in of long tools in a well, typically a perforation gun, the tool may extend through the wellhead valves while the sluice opening still is open. During such operations, the well safety valve constitutes the only barrier between the well and the atmosphere. Should the perforation gun be dropped during sluicing, it may damage the well safety valve, thus further removing a barrier.

According to the prior art, so-called snubbing is used to lock-in long tools while the well safety valve is closed. Snubbing operations should be familiar to a specialist and are therefore not described in further detail. During snubbing operations, there is sometimes deviation from the requirement of at least two barriers between the reservoir and the atmosphere, the well safety valve providing the only barrier.

It is known to place devices in the well above the well safety valve for the purpose of protecting the well safety valve against falling objects. The devices may comprise closing mechanisms arranged to constitute an additional barrier. The applicant is not aware of devices of this type being used in active wells.

It is also known to install an additional well safety valve in the well above the primary well safety valve. This additional valve constitutes a backup valve to the primary well safety valve.

Both of the latter solutions are vulnerable and may be damaged by objects falling at high velocity.

The snubbing method is used to reduce the danger of dropping the tool string and thereby damaging the well safety valve. Should still the tool string be dropped, the tool most likely will damage the well safety valve. At worst, if the tool string comprises a perforation gun, it is conceivable that the perforation gun incorrectly is fired while being sluiced into the well. The wellhead valves then will be damaged. Thereafter pieces may fall down and damage the well safety valve. In the case of re-perforating an underbalanced well, an incident such as the one described above may cause loss of well control, render impossible to close the well.

BRIEF SUMMARY OF THE INVENTION

The object of the invention is to remedy the disadvantages of the prior art.

The object is achieved in accordance with the invention through the features disclosed in the description below and in the subsequent patent claims.

By providing a drill string with a brake nose, i.e. a device that is attached to the front end portion of the tool string and that is arranged to limit the maximum fall velocity of the tool string, and also a catch device being placed above the well safety valve and being arranged to catch the brake nose prior to engaging the well safety valve, the danger of damaging the well safety valve due to a dropped well tool is reduced significantly. During the development work of the invention, special emphasis has been placed on ensuring that a possible falling tool string will not inflict damage either to the object of the invention or to the well safety valve.

Prior to initiating the very sluicing operation of a tool string, for example a perforation gun, commences, a landing sleeve is mounted in the well above the well safety valve. Moreover, the landing sleeve may comprise a flap valve that may constitute an additional barrier.

A brake nose is mounted onto the tool string, after which the tool string is sluiced into the well. Having sluiced the tool string into the well, necessary pressure control equipment is install in the well.

The tool string is moved down into the well until the brake nose lands in the landing sleeve, whereupon the brake nose is connected to the landing sleeve. Then the brake nose is disconnected from the tool string.

The brake nose is formed in a manner not allowing it to be disengaged from the tool string before being connected to the landing sleeve. Inadvertently disconnecting the brake nose from the tool string before engaging with the landing sleeve therefore is impossible.

The tool string then is moved through the well safety valve and further down into the well where the work operation is carried out. Thereafter the tool string is pulled up through the well safety valve and into the brake nose where the tool string is connected to the brake nose. The brake nose is reconnected to the tool string in a manner not allowing it to be disengaged from the tool string without being placed in the landing sleeve. Should the tool string be dropped while en route from the landing sleeve to the surface, the braking function of the brake nose thus remains intact.

Should the tool string be dropped and fall down towards the well safety valve, the tool string will attain a maximum velocity controlled by the shape of the brake nose, inasmuch as the brake nose may be provided with labyrinth-profiles and/or choke rings that cause a turbulence loss around the brake nose. The turbulence loss remains a function of the brake nose velocity. Calculations show that a brake nose according to the invention potentially may reduce the maximum falling velocity of the tool string to a tenth of the maximum velocity as compared to no brake nose being attached. The remaining energy of the fall is absorbed when the brake nose is moved into the landing sleeve, and through braking and stopping the tool string without damaging the well safety valve.

BRIEF DESCRIPTION OF THE DRAWINGS

In the following a non-limiting example of a preferred embodiment is described and is illustrated in the attached drawings, wherein.

DESCRIPTION OF THE PREFERRED EMBODIMENTS

Figure 1:
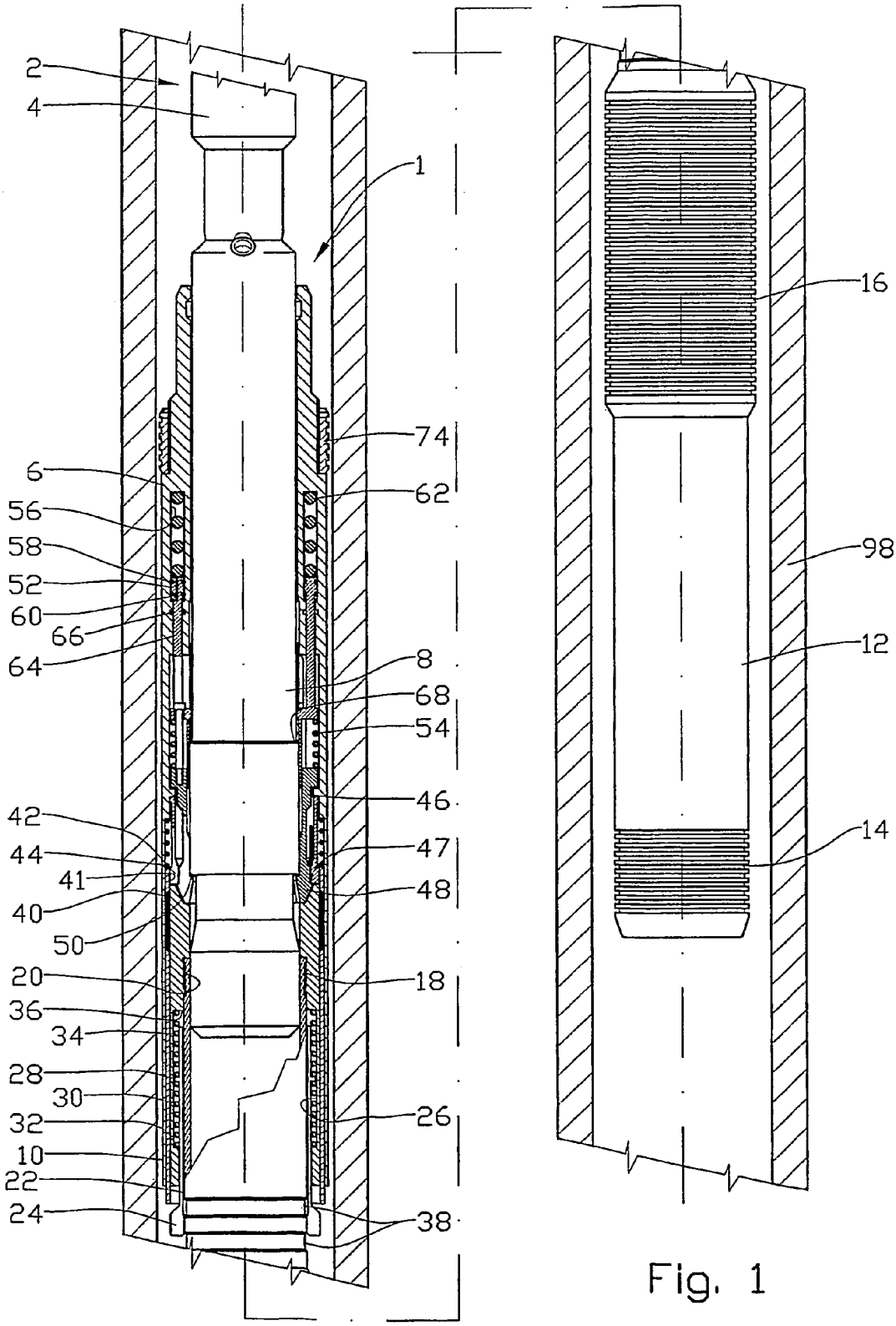
FIG. 1 depicts a brake nose being connected to a tool string, and the tool string being en route down into the well.
Figure 2:
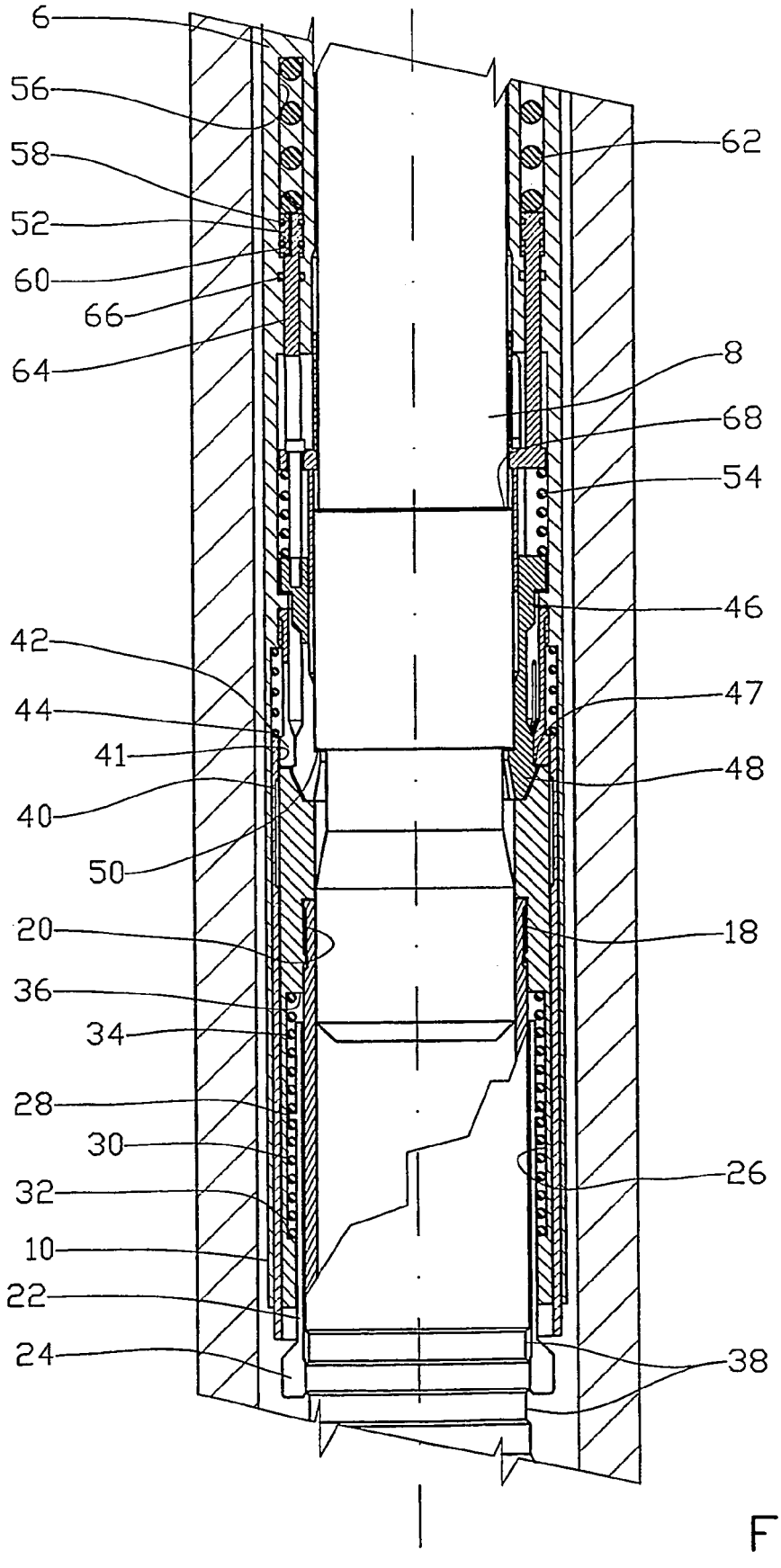
FIG. 2 depicts a section of FIG. 1 at a larger scale.

On the drawings, reference number 1 refers to a brake nose being connected to a leading end 4 of a tool string 2. The leading end 4 of the tool string 2 is understood to be the end portion being moved down into the well. The brake nose 1 comprises a relatively lengthy cylinder-shaped brake nose housing 6 enclosing a tool nose 8 connected to the tool string 2, and a tubular brake spindle 12 connected to a leading end portion 10 of the brake nose housing 6.

Externally the brake spindle 12 is provided with a first labyrinth 14 and a second labyrinth 16, the second labyrinth 16 having a larger diameter than that of the first labyrinth 14. The brake spindle 12 extends a distance into the leading end portion 10 of the brake nose housing 6 and is connected to the brake nose housing 6 by means of a screw connector 18 fitting complementary into a thread 20 in the brake nose housing 6.

An axially split brake latch ring 22 surrounds the brake spindle 12 and has its latches 24 placed outside the leading end portion 10 of the brake nose housing 6. The brake latch ring 22 protrudes into an annulus 26 in the leading end portion 10 of the brake nose housing 6, the annulus 26 being defined by the brake nose housing 6 and the brake spindle 12.

The inner end portion of the brake latch ring 22 is provided with a ring-shaped flange 28 protruding radially outwards. A first spiral-shaped latch ring spring 30 extends from the flange 28 and axially out towards an outer shoulder 32 in the brake nose housing 6. A second spiral-shaped latch ring spring 34 extends from the opposite side of the flange 28 and axially inwards toward an inner shoulder 36 in the brake nose housing 6. The latch ring springs 30 and 34 are arranged to hold the brake latch ring 22 in an axially centred position wherein the latches 24 are located between two ring-shaped release grooves 38 in the brake spindle 12. By moving the brake latch ring 22 axially until the latches 24 correspond with one of the release grooves 38, the latches 24 may be moved radially into the corresponding release groove 38. The brake latch ring 22, the latches 24, the latch ring springs 30, 34 and the release grooves 38 thereby constitute a bayonet connector.

A locking slide 40 is movably connected to the brake nose housing 6 and protrudes axially upwards from the leading end portion 10 of the brake nose housing 6 and encircling an axially split lock mandrel 42. In its locking position the locking slide 40 is moved downward by a locking slide spring 44, thus projecting out of the leading end portion 10 of the brake nose housing 6.

The lock mandrel 42, which is fixed axially in the brake nose housing 6, encircles an axially split tool lock ring 46. The tool lock ring 46 is provided with latches 48 fitting complementary into an encircling catch shoulder 50 in the tool nose 8. The tool lock ring 46 is connected to a one-way, moveable annular piston 52. Thus the tool lock ring 46 is arranged in a manner allowing it to be moved in the direction of the annular piston 52 without moving the annular piston 52, but if the annular piston 52 is moved in the same direction, the tool lock ring 46 also is moved. The tool lock ring 46 is moved in its locking direction by a tool latch ring spring 54.

The annular piston 52 runs within an annular cylinder 56 formed in the brake nose housing 6. The annular piston 52 is provided with gaskets 58, which seal against the annular cylinder 56 and a throttled through-bore 60. A spiral spring 62 is placed in the annular cylinder 56 and extends between the annular piston 52 and the bottom of the annular cylinder 56. The annular piston 52 is connected to the tool lock ring 46 by means of a annular piston rod 64. Gaskets 66 seal between the annular piston rod 64 and the brake nose housing 6.

An encircling tensioning shoulder 68 on the tool nose 8 is arranged to bear against the annular piston rod 64 when the tool nose is moved upwards in an axial direction away from the leading end portion 10 of the brake nose housing 6.

In its locked condition, the tool nose 8 is axially moveable for a limited distance within the brake nose housing 6. In the upwards direction, the movement is restricted by the tensioning shoulder 68 bearing against the annular piston rod 64, and in the downwards direction by the latches 48 bearing against the catch shoulder 50.

Externally the brake house nose 6 is provided with a choke ring 74 arranged to form turbulent flow around the brake nose 1 if the tool string 2 should be dropped down into the well.

Prior to sluicing the tool string into the well through for example a production tubing 98, a landing sleeve 100 is placed in the production tubing 98 immediately above the well safety valve 102 of the well. The landing sleeve 100 is provided with a ring gasket 104 arranged to seal between the landing sleeve 100 and the production tubing 98, and a slips 106 arranged to connect the landing sleeve 100 to the production tubing 98. A brake tubing 108 is fixedly connected to the landing sleeve 100 and extends upwards from the landing sleeve 100. At its upwards-protruding end portion 110, the brake tubing 108 is formed with an upper bore 112 corresponding in dimension with the second labyrinth 16 of the brake spindle 12. The upper bore 112 extends a distance downward in the brake tubing 108. The brake tubing 108 has a lower bore 114 corresponding in dimension with the first labyrinth 14. An encircling catch groove 116 is formed in the upper bore 112 immediately inside the upper end portion 110.

Figure 3:
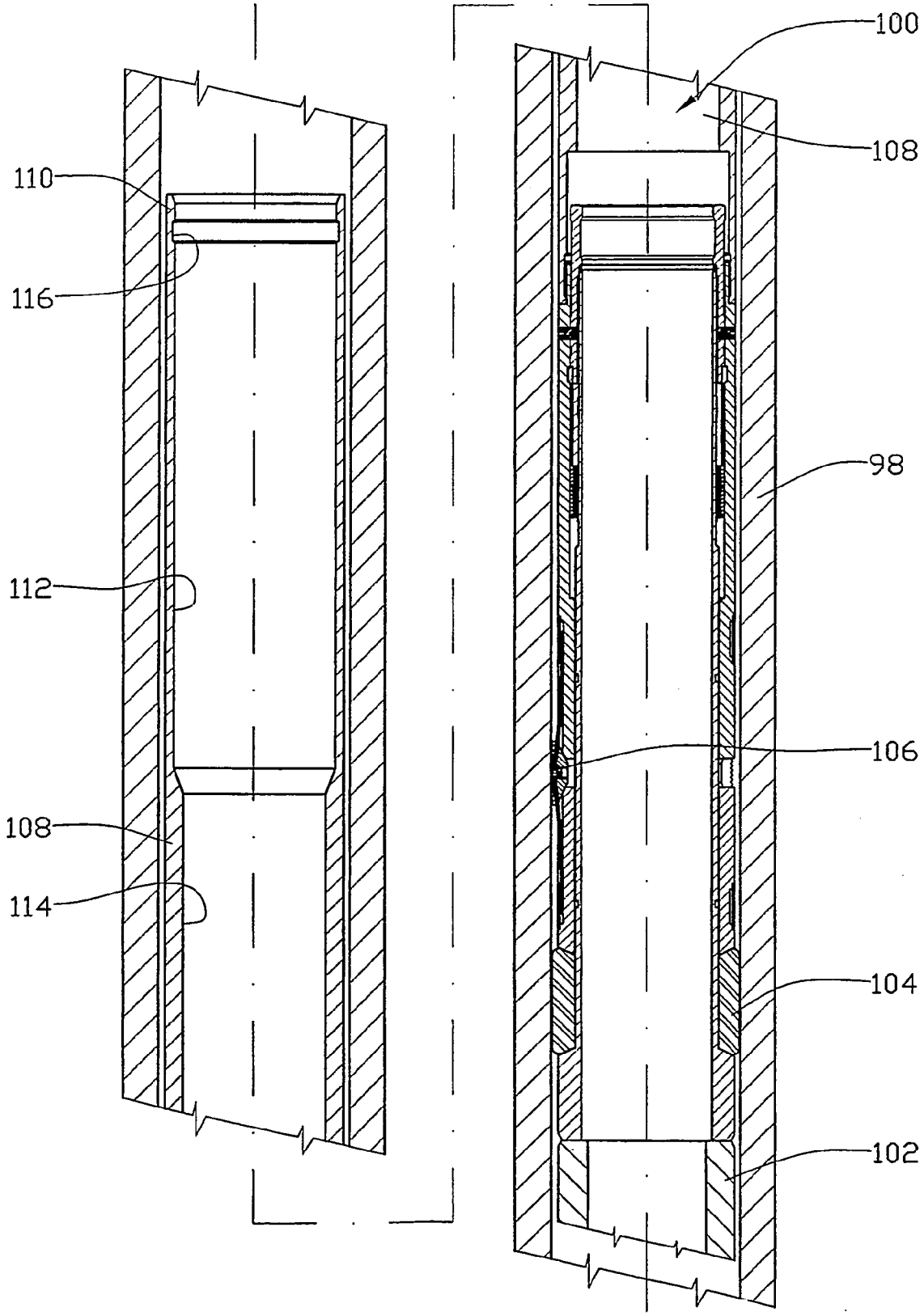
FIG. 3 depicts a landing sleeve comprising a brake cylinder, the landing sleeve being fixedly placed in a well above the well safety valve.
Figure 4:
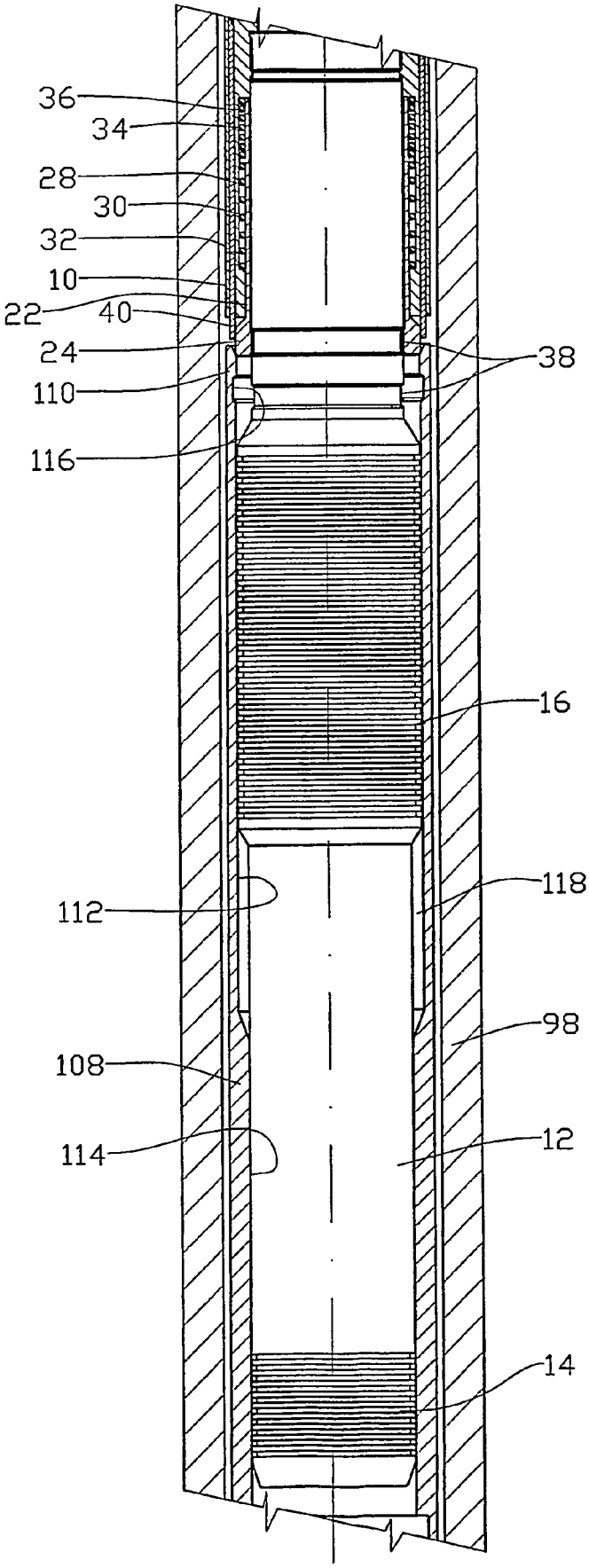
FIG. 4 depicts a section of the brake nose while en route into the brake cylinder.
Figure 5:
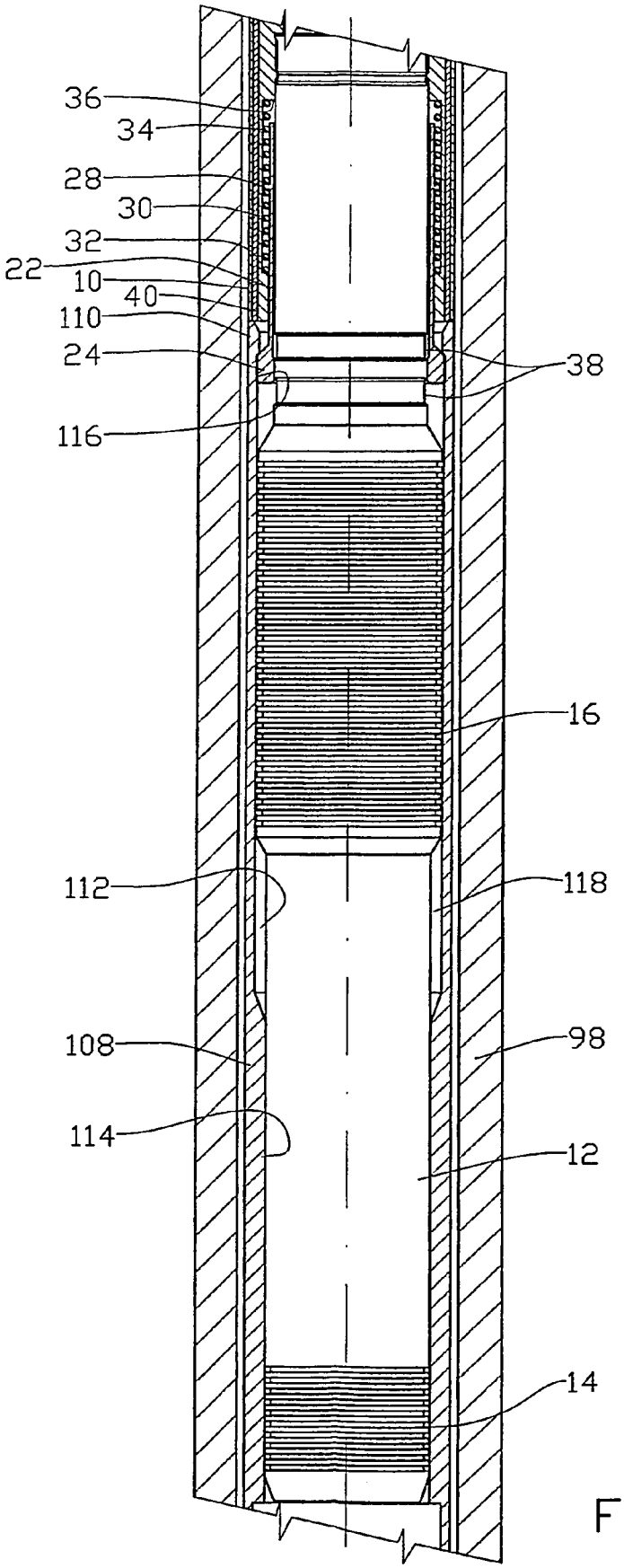
FIG. 5 depicts the same as FIG. 4, but here the brake nose is completely pushed into the brake cylinder.
Figure 6:
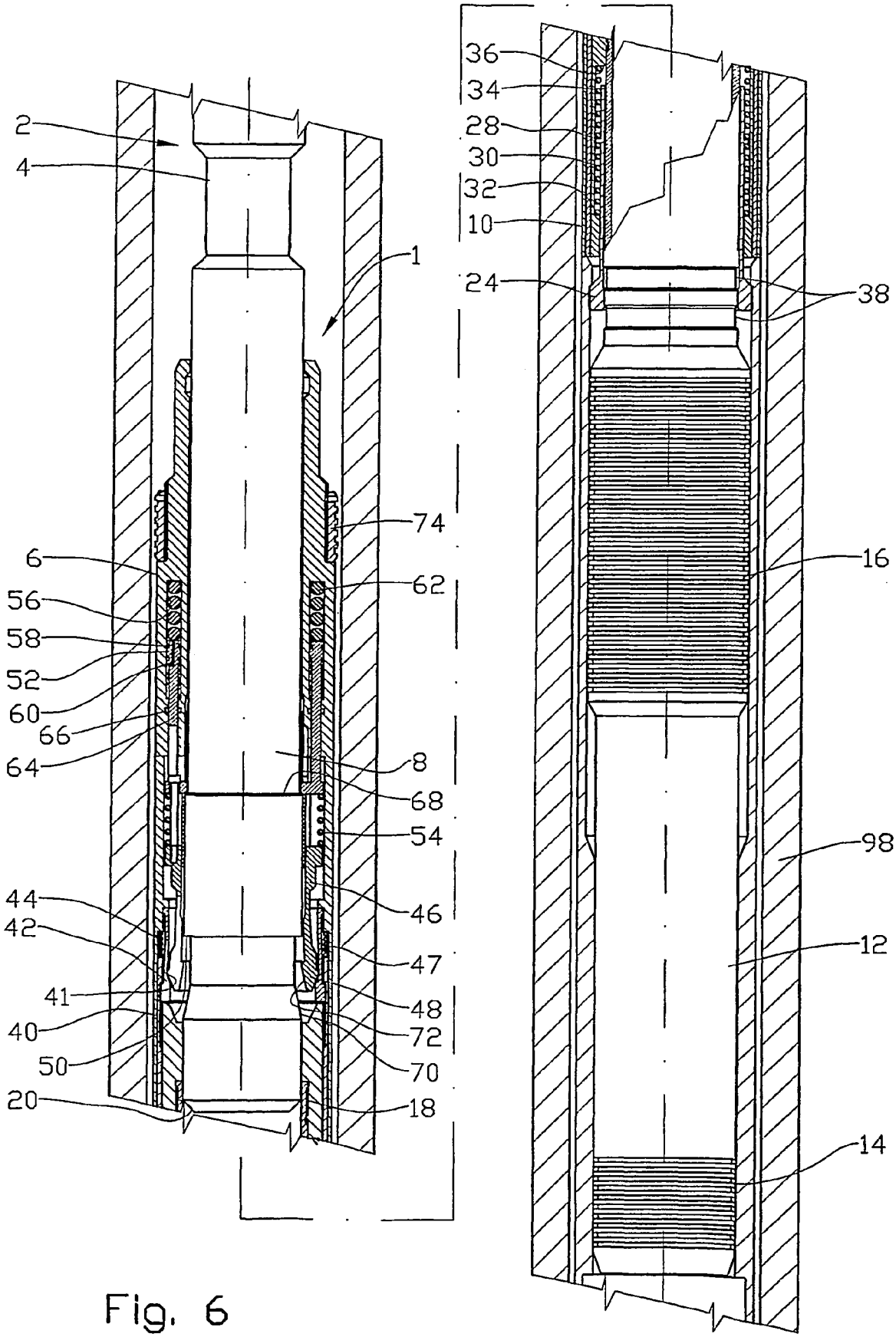
FIG. 6 depicts the brake nose after having pushed the delay cylinder of the brake nose is moved into its releasing position.
Figure 7:
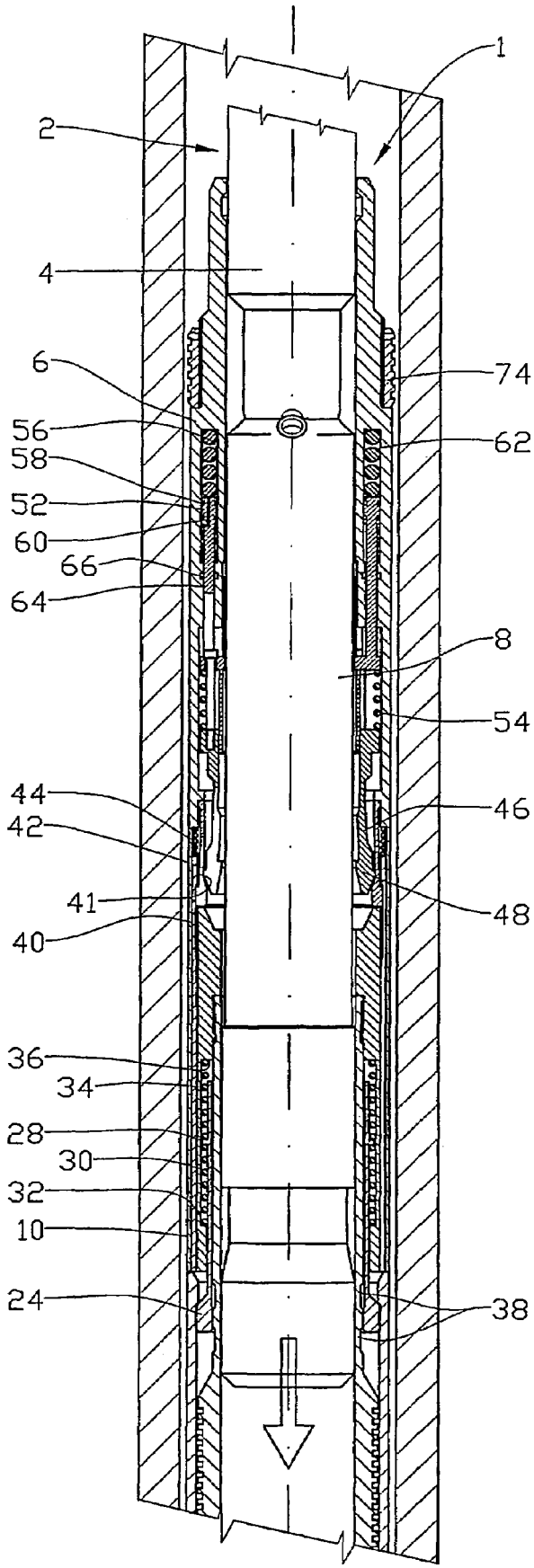
FIG. 7 depicts the brake nose in its deadlock position in the landing sleeve while the tool nose is moved onwards out of the brake nose.
Figure 8:
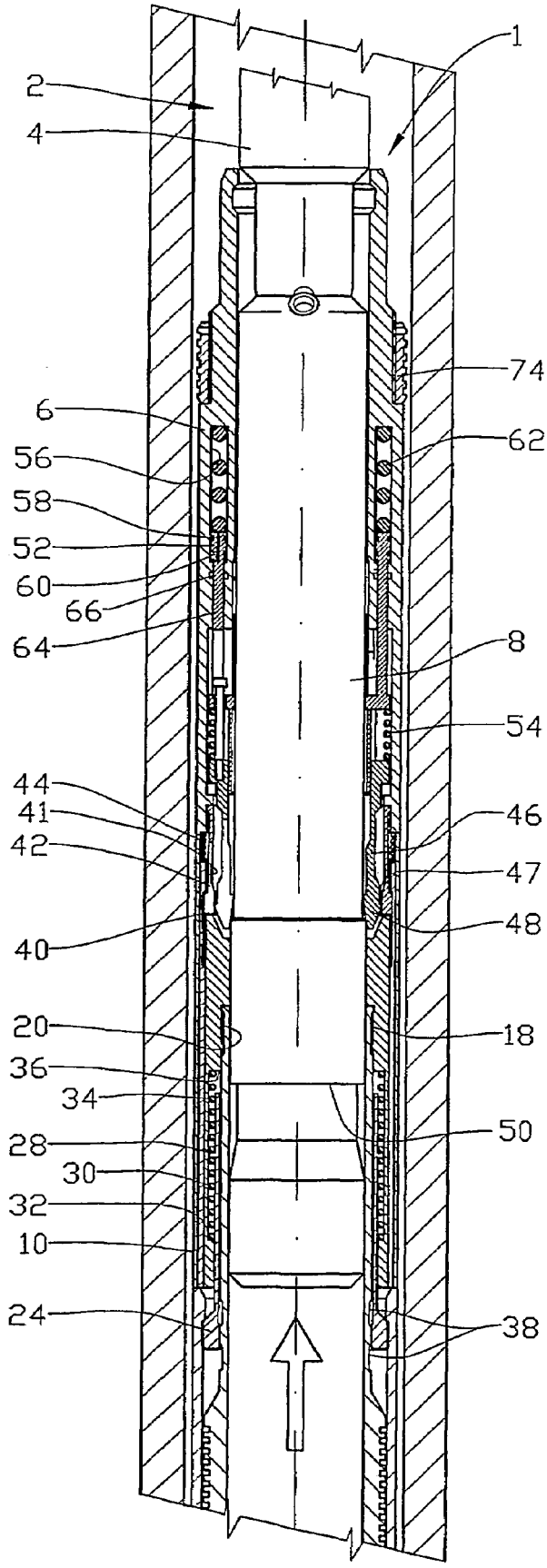
FIG. 8 depicts the brake nose immediately before the tool nose, which is moved upwards, is pulled into its locking position within the brake sleeve.
Figure 9:
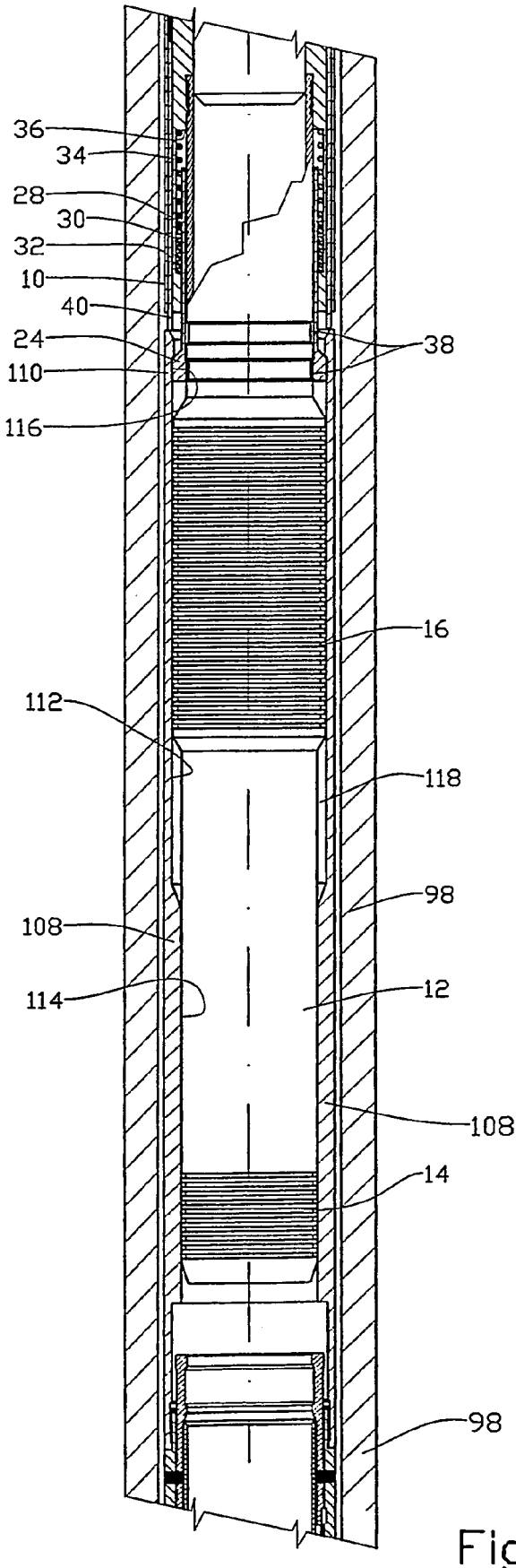
FIG. 9 depicts the brake nose while being pulled out of its locking position within the brake cylinder.

The landing sleeve 100 is connected to the production tubing 98 in a manner per se by anchoring the ring gasket 104 and the slips 106, see FIG. 3.

Having tested the anchoring between the landing sleeve 100 and the production tubing 98, the tool string 2 assembled with the brake nose 1 is sluiced into the production tubing 98 and is moved downwards, see FIG. 1, until the brake spindle 12 is moved into the brake tubing 108. The first labyrinth 14 and the second labyrinth 16 bearing against the lower bore 114 and the upper bore 112, respectively, throttle fluid through-flow between the brake tubing 108 and the brake spindle 12. This confinement of the fluid volume, which is located in the annular space 118 between the brake tubing 108 and the brake spindle 12, and which is defined by the first labyrinth 14 and the second labyrinth 16, is subjected to a pressure increase due to different diameters of the bores 112 and 114, the pressure increase reducing the movement speed of the brake spindle 12 into the brake tubing 108. As the confined fluid bleeds past the labyrinth 14 and 16, the brake spindle 12 is moved further into the brake tubing 108 until the brake latch ring 22 bears against the upper end portion 110 of the brake tubing 108, see FIG. 3.

When the brake spindle 12 is moved further into the brake tubing 108, the brake latch ring 22 is moved along the brake spindle 12, whereby the second latch ring spring 34 is tensioned. The latches 24 of the brake latch ring 22 may be moved into the upper bore 112 and onwards into the catch groove 116 when the catch latches 24 correspond with the upper of the release grooves 38 of the brake spindle 12. In the locked position, the brake spindle 12 may only be moved out of the brake tubing 108 by tensioning the relatively stiff first latch ring spring 30, thereby moving the catch latches 24 of the brake latch ring 22 until they correspond with the lower of the release grooves 38.

Simultaneous with moving the brake spindle 12 completely into the brake tubing 108, the locking slide 40 is brought to bear against the upper end portion 100 of the brake tubing 108 and thus is moved upwards relative to the brake nose housing 6, whereby the locking slide spring 44 is tensioned. Thereby the lock slide's 40 ring-shaped contact face 41 against the lock mandrel 42 is moved, allowing the lock mandrel 42 to expand radially outwards, whereby the tool lock ring's 46 external locking dogs 47, which are resting against the lock mandrel 42, may be released.

Having the lock mandrel 42 in this expanded condition, the tool lock ring 46 may be moved upwards in the brake nose housing 6 by means of the tool nose 8, inasmuch as the tensioning shoulder 68 of the tool nose 8 bears against the annular piston rod 64, whereby the annular piston 52 is moved upwards within the annular cylinder 56 simultaneous with the spiral spring 62 being tensioned. Due to the throttled through-bore 60, the movement speed is restricted. Having axially moved the tool lock ring 46 sufficiently, the internal geometry of the lock mandrel 42 is formed such that the external locking dogs 47 of the tool lock ring 46 may expand radially outwards. Thereby the catch latches 48 of the tool lock ring 46 are moved radially outwards, allowing the tool nose 8 and the tool string 2 to be moved downwards through the brake nose housing 6.

At slow speed due to the throttled through-bore 60, the spiral spring 62 moves the annular piston 52 out of the annular cylinder 56. The tool lock ring 46 thereby is moved back into its locking position.

When the tool nose 8 is moved upwards and into the brake nose housing 6, the tool lock ring 46 is moved upwards and tensions the tool latch ring spring 54 without moving the annular piston 52, inasmuch as the tool lock ring 46, as described above, is moveable one-way relative to the annular piston rod 64.

When the catch latches 48 correspond with the catch shoulder 50, the tool lock ring spring 54 moves the tool lock ring 46 to locking engagement behind the catch shoulder 50.

Thus the brake nose 1 is locked to the landing sleeve 100. To verify securing of the tool nose 8 by the tool lock ring 46, a downward directed force may be exerted onto the tool string 2 to verify that the tool nose 8 is in locked position within the brake nose housing 6.

From a locking point of view, it is important to ensure that the brake nose 1 has returned to its initial position in the brake nose housing 6. Should the tool string 2 be dropped during the following retrieval, the tool nose 8 otherwise may be moved out of the brake nose housing 6 if dropped down into the well.

The brake nose 1 may be released from the brake tubing 108 by means of a relatively strong jerk that tensions the first latch ring spring 30, thereby moving the brake latch ring 22 until the catch latches 24 correspond with the lower release groove 38 and thus may be moved radially inwards from the catch groove 116.

When the brake nose 1 is in the locked position in the brake tubing 108, a sustained and relatively small upwards tensile force will cause the tool nose 8 to release in the brake nose housing 6, while a relatively strong jerk releases the brake nose 1 from the brake tubing 108.

The invention claimed is:

1. A device for a tool string for insertion in a well, comprising:

a brake nose arranged at a leading tip of the tool string; and a tool nose connected to the brake nose axially in a one-way releasable manner, wherein a landing sleeve configured to receive the brake nose is connected in a locking manner to a well tubing.

2. A device according to claim 1, wherein the landing sleeve is positioned immediately above a safety valve of the well.

3. A device according to claim 2, wherein the landing sleeve includes a brake tubing.

4. A device according to claim 3, wherein a through-going pipe opening of the landing sleeve and/or the brake tubing comprises an upper bore and a lower bore, and wherein the diameter of the lower bore differs from the diameter of the upper bore.

5. A device according to claim 4, wherein the brake nose is provided with a brake spindle configured to be moved into the upper and lower bores.

6. A device according to claim 5, wherein the brake spindle is externally provided with a first labyrinth and a second labyrinth, and wherein the labyrinths together with the corresponding bores constitute labyrinth seals for a confined annular space between the brake spindle and the brake tubing.

7. A device according to claim 4, wherein the diameter of the lower bore is smaller than the diameter of the upper bore.

8. A device according to claim 3, wherein the brake nose is configured to be locked to the brake tubing by means of a releasable bayonet connector.

9. A device according to claim 1, wherein the tool nose is secured in the brake nose by a tool lock.

10. A device according to claim 9, wherein release of the tool lock is blocked by means of an axially movable locking slide.

11. A device according to claim 9, wherein the tool lock is connected to a piston in a one-way moveable manner.

12. A device according to claim 1, wherein the brake nose and the leading tip are arranged along a common axis.

13. A braking device for limiting a velocity of a tool string, comprising:

a cylindrical housing connected to the tool string; and a brake spindle comprising first and second braking sections, wherein the first braking section comprises a first labyrinth, and the second braking section comprises a second labyrinth, and wherein the second labyrinth has a larger diameter than the first labyrinth.

14. A braking device according to claim 13, wherein:

the second labyrinth is closer to the tool string than the first labyrinth.

15. A braking device according to claim 13, wherein:

the brake spindle is surrounded by a latch ring; and the latch ring protrudes into an annulus at a leading end of the cylindrical housing.

16. A braking device according to claim 15, wherein:

the latch ring is provided with a protruding flange; and first and second spiral-shaped springs extend from the flange.

17. A braking device according to claim 13, wherein the first and second braking sections are separated by a non-braking section.

18. A braking device for use with a tool string, comprising:

a cylindrical housing connected to the tool string; and a brake spindle comprising a plurality of labyrinths configured to reduce a velocity of the tool string, wherein diameters of the labyrinths are different.

19. A braking device according to claim 18, wherein:

the labyrinths define at least one annular space where fluid at an increased pressure can be confined.

20. A braking device according to claim 18, wherein:

the cylindrical housing comprises a choke ring configured to form a turbulent flow upon falling of the tool string.

* * * * *